US008302667B2

(12) United States Patent
Yamamura et al.

(10) Patent No.: US 8,302,667 B2
(45) Date of Patent: Nov. 6, 2012

(54) CAST IRON SEMI-FINISHED PRODUCT EXCELLENT IN WORKABILITY AND METHOD OF PRODUCTION OF THE SAME

(75) Inventors: Hideaki Yamamura, Futtsu (JP); Wataru Ohashi, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/173,154

(22) Filed: Jun. 30, 2011

(65) Prior Publication Data

US 2011/0303329 A1 Dec. 15, 2011

Related U.S. Application Data

(63) Continuation of application No. 12/655,199, filed on Dec. 23, 2009, now abandoned, which is a continuation of application No. 10/544,438, filed on Aug. 3, 2005, now abandoned.

(30) Foreign Application Priority Data

| | | |
|---|---|---|
| Feb. 12, 2003 | (JP) | 2003-033201 |
| Jul. 29, 2003 | (JP) | 2003-203083 |
| Jan. 9, 2004 | (JP) | 2004-004357 |

(51) Int. Cl.
*B22D 11/10* (2006.01)
*B22D 27/00* (2006.01)

(52) U.S. Cl. ..... 164/473; 164/476; 164/55.1

(58) Field of Classification Search ..... 164/476, 164/477, 473, 55.1
See application file for complete search history.

(56) References Cited

U.S. PATENT DOCUMENTS

| | | | |
|---|---|---|---|
| 2,185,894 | A | 1/1940 | Hultgren |
| 2,855,336 | A | 10/1958 | Curry |
| 3,155,498 | A | 11/1964 | Jandras |
| 3,891,432 | A | 6/1975 | Nakae et al. |
| 4,194,906 | A | 3/1980 | Krantz et al. |
| 4,401,469 | A | 8/1983 | Rehder |
| 4,891,076 | A | 1/1990 | Kovacs |

FOREIGN PATENT DOCUMENTS

| | | |
|---|---|---|
| CA | 1190400 | 7/1985 |
| CN | 1104562 A | 7/1995 |
| FR | 1349437 | 1/1964 |
| GB | 525478 | 8/1940 |
| GB | 636579 | 5/1950 |
| JP | 52-148415 | 12/1977 |
| JP | 60-243217 | 12/1985 |

(Continued)

OTHER PUBLICATIONS

Supplementary European Search Report dated Aug. 26, 2009 issued in corresponding European Application No. 04 70 9715.

(Continued)

*Primary Examiner* — Kevin P Kerns
(74) *Attorney, Agent, or Firm* — Kenyon & Kenyon LLP

(57) ABSTRACT

The present invention provides tough cast iron and cast iron semi-finished products excellent in workability without heat treatment requiring massive heat energy and long time and a method of production enabling these to be efficiently produced, that is, cast iron of ingredients of white cast iron where particles of spheroidal graphite or flattened graphite are dispersed, cast iron where the ingredients of the white cast iron satisfy, by wt %, (% C)≦4.3−(% Si)÷3 and C≧1.7% and where the particles of spheroidal graphite are dispersed at a density of 50 particles/mm$^2$ or more, or cast iron where the particles of flattened graphite have a width of 0.4 mm or less and a length of 50 mm or less.

3 Claims, 4 Drawing Sheets

FOREIGN PATENT DOCUMENTS

| | | |
|---|---|---|
| JP | 06-071390 | 3/1994 |
| JP | 07-138636 | 5/1995 |

OTHER PUBLICATIONS

Canadian Office Action dated Dec. 19, 2008 issued in corresponding Canadian Patent Application No. 2,515,509.

Muto Mobile Science & Technology, CNKI:ISSN:1005-2550.0. Jan. 4, 1985, pp. 23-26, pub. Dec. 31, 1985.

Maruzen, Cast Iron Handbook, edited by Japanese Cast Iron Association, May 20, 1973., pp. 1108-1115 and 1138-1143.

Steel, and other Alloys; Henry Marion Howe, 1903 D. Van Nostrand Company, p. 430-438.

The Encyclopedia America, A Library of Knowledge, In Thirty Volumes, (The Encyclopedia Americana Corp.) 1919, p. 387.

Iron and Steel Institute of Japan, 3rd ed, Tekko Binran, pp. 114-117. 1982, translation.

CAST IRON SEMI-FINISHED PRODUCT EXCELLENT IN WORKABILITY AND METHOD OF PRODUCTION OF THE SAME

This application is a continuation application under 35 U.S.C. §120 of prior application Ser. No. 12/655,199 filed Dec. 23, 2009, now abandoned, which is a continuation application under 35 U.S.C. §120 of prior application Ser. No. 10/544,438 filed Aug. 3, 2005, now abandoned, which is a 35 U.S.C. §371 of PCT/JP04/01386 filed Feb. 10, 2004, wherein PCT/JP04/01386 was filed and published in the Japanese language.

TECHNICAL FIELD

The present invention relates to cast iron and a cast iron semi-finished product excellent in workability and a method of production of the same.

BACKGROUND ART

As tough cast iron, there are ductile cast iron obtained by adding Mg, Ca, Ce, and other elements of a graphite spheroidization agent and performing graphite spheroidization and compact vermicular cast iron (hereinafter referred to as "C/V cast iron". Further, there is malleable cast iron obtained by heat treating white pig iron obtained by white pig casting.

In that C/V cast iron, the graphite does not become spheroidal and is present as an intermediate form of graphite masses etc. Further, malleable cast iron is good in castability and is rich in ductility and tough like with steel upon being heat treated, so is important as a material for machine structures. This malleable cast iron is classified into white heart malleable cast iron, black heart malleable cast iron, cast iron having a special base material, etc.

Among these, in black heart malleable cast iron, if leaving malleable cast iron castings as cast, they exhibit a white pig structure. This is hard and brittle, so in the production process, the iron is annealed for graphitization.

The time and temperature of the annealing conditions are determined based on numerous other casting factors, but usually this annealing includes two stages of annealing. The first stage annealing is performed at 900 to 980° C. of temperature over 10 to 20 hours. In this treatment, the free cementite is completely decomposed. The second stage annealing is performed by a combination of gradual cooling in a temperature range of 700 to 760° C. for the purpose of direct graphitization and long term treatment at 700 to 730° C. in range for graphitization of the cementite in the pearlite. In this way, the time required for the overall annealing process is usually 20 to 100 hours or so as described in the Iron and Steel Institute of Japan, 3rd Edition, *Tekko Binran*, Vol. V. "Casting, Forging, and Powder Metallurgy", pp. 115 to 116, 1982.

Ductile cast iron and malleable cast iron can be rolled to a certain extent. Rolling cast semi-finished products to obtain cast iron plate, cast iron sheet, cast iron bars, and other rolled cast iron can be expected to open up uses for diverse applications. However, such cast iron has narrow rolling conditions and its applications are limited.

Further, as the method for obtaining the cast semi-finished products serving as the rolled materials, usually the casting method of pouring melt into a sand or other mold to obtain cast semi-finished product has been used, but sometimes continuous casting is performed as a means for raising productivity.

However, in the method of the above reference, there is the problem that with a malleable cast iron casting, a long time is required for the graphitization, so the productivity is remarkably poor and, further, the long heating results in oxidation and decarburization of the surface, so heating in a nonoxidizing atmosphere is required to suppress this and the treatment costs rise. Further, despite the annealing cycle being appropriate, the graphite precipitated after the treatment is not spheroidal. Therefore, this cannot be said to be graphitization providing sufficiently satisfactory characteristics. In particular, in terms of the balance of strength and ductility and the fatigue strength, malleable cast iron is not that superior compared with the usual rat cast iron. Further improvement from these characteristics is therefore desired.

As opposed to this, Japanese Patent Publication (A) 7-138636 does not describe a method for treatment for graphitization in a short time, and the graphite precipitating after treatment is not completely spheroidal. Further, with cast iron obtained by rolling ductile cast iron or malleable cast iron, the graphite forms thin flakes distributed in a laminar form at the time of rolling, so the workability ends up becoming poor.

Further, in continuous casting of usual cast iron, graphite molds are used for the purpose of prevention of chill, but white cast iron is difficult to continuously cast due to the wide region of copresence of the solid and liquid phases. As shown in Japanese Patent No. 4074747, therefore, this is not performed much at all.

In this way, as shown in Japanese Patent No. 3130670, using a twin-roll casting machine for white pig casting in sheets, and heat treating the result to produce cast iron sheets comprised of malleable cast iron is also conceivable as a method of production of tough sheets of cast iron, but in this case, in the same way as the case of production of malleable cast iron, the result becomes graphite masses, i.e., the spheroidization of the graphite is insufficient, so there is the problem of insufficient workability.

DISCLOSURE OF THE INVENTION

The present invention was made in view of this situation and has as its object the provision of tough cast iron and cast iron semi-finished products excellent in workability without heat treatment requiring massive heat energy and long time and a method of production enabling efficient production of these. Note that the "cast iron and cast iron semi-finished products" referred to in the present invention includes cast iron itself, as-cast cast iron semi-finished products obtained by strip casting etc., and rolled cast iron semi-finished products obtained by rolling the cast iron or cast iron semi-finished products. The gist of the invention is as follows:

(1) A cast iron and a cast iron semi-finished product excellent in workability characterized by being comprised of cast iron of an ingredient system of white cast iron inside of which particles of spheroidal or flattened graphite with outside surfaces partially or completely covered with ferrite are dispersed independently or complexly.

(2) A cast iron and a cast iron semi-finished product excellent in workability as set forth in (1), characterized in at the particles of spheroidal graphite or flattened graphite are dispersed at a density of 50 particles/$mm^2$ or more.

(3) A cast iron and a cast iron semi-finished product excellent in workability as set forth in (1), characterized in that the particles of spheroidal graphite or flattened graphite have a width of 0.4 mm or less and a length of 50 mm or less.

(4) A cast iron and a cast iron semi-finished product excellent in workability as set forth in (1), characterized in that the ratio of the ferrite in the cast iron is 70% or more.

(5) A cast iron and a cast iron semi-finished product excellent in workability as set forth in any one of (1) to (4), characterized in that the ingredients giving white cast iron are, by wt %, a composition satisfying (% C)≦4.3−(% Si)÷3 and C≧1.7%.

(6) A cast iron and a cast iron semi-finished product excellent in workability as set forth in (5), characterized by further including as cast iron ingredients at least one of Cr≧0.1 wt % and Ni≧0.1 wt %.

(7) A cast iron and a cast iron semi-finished product excellent in workability as set forth in any one of (1) to (4) characterized in that the particles of spheroidal or flattened graphite are bonded complexly with at least one type of particles of oxides, sulfides, nitrides, or their complex compounds containing at least one of Mg, Ca, and an REM.

(8) A cast iron and a cast iron semi-finished product excellent in workability as set forth in (7), characterized in that the at least one type of particles of oxides, sulfides, nitrides, or their complex compounds have diameters of 0.05 to 5 μm.

(9) A cast iron and a cast iron semi-finished product excellent in workability as set forth in any one of (1) to (4) characterized in that said white cast iron semi-finished product is sheet cast iron, plate cast iron, or rail cast iron.

(10) A cast iron and a cast iron semi-finished product excellent in workability as set forth in (9), characterized in that said cast iron semi-finished product has a thickness of 1 to 400 mm.

(11) A method of production of a cast iron semi-finished product excellent in workability obtained by casting a melt of ingredients comprised of white cast iron to which a spheroidalization agent has been added and rolling the obtained semi-finished product.

(12) A method of production of a cast iron semi-finished product excellent in workability as set forth in (11), characterized in that said spheroidalization agent includes at least one of Mg, Ca, and an REM.

(13) A method of production of a cast iron semi-finished product excellent in workability as set forth in (11), characterized by further heat treating the rolled semi-finished product.

BRIEF DESCRIPTION OF THE DRAWINGS

FIG. 1(*a*) is a photograph of the metal structure showing the structure of Invention Example No. 1a, FIG. 1(*b*) the structure of Invention Example No. 1b, and FIG. 1(*c*) the structure of Comparative Example No. 1.

BEST MODE FOR WORKING THE INVENTION

Figure 1A:
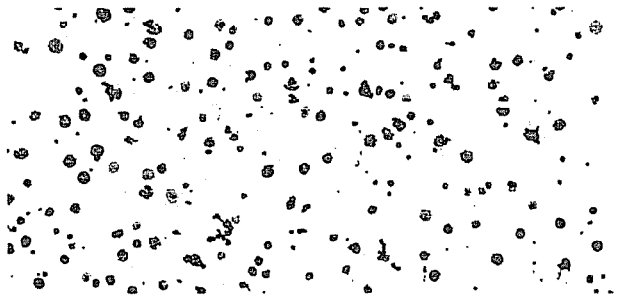
FIG. 1 gives photographs of the metal structures of sheet products according to an embodiment of the present invention.

The inventors newly discovered that by casting a melt of white cast iron ingredients to which a spheroidalization agent has been added so as to obtain a cast iron semi-finished product, rolling that cast semi-finished product, then heat treating it, it is possible to produce spheroidal graphite cast iron excellent in workability comprised of rolled cast iron in which particles of spheroidal graphite are dispersed.

Specifically, they added a spheroidalization agent to a melt of cast iron of white cast iron ingredients, then cast this. The as-cast semi-finished product obtained failed to reveal any particles of graphite in its structure. Next, they rolled this cast semi-finished product at a relatively low temperature, then heat treated it at a relative high temperature. The obtained cast iron showed particles of spheroidal graphite in its structure. They learned from bending the cast iron that the workability was extremely good. They found that the particles of spheroidal graphite in the cast iron were covered over part or all of their outer surfaces with ferrite and that cast iron with a large ferrite phase is good in workability. The same results as the above were obtained for cast iron in the form of sheets, plates, rails, etc.

Further, they newly discovered that in the case of cast iron where the particles of the dispersed graphite are not spheroidal, but flattened, a good workability is obtained and further the vibration dampening and sound absorbing performance are superior and that it was possible to produce cast iron in which particles of flattened graphite are dispersed by casting a melt of the white cast iron ingredients into which a spheroidalization agent has been added and rolling that cast semi-finished product.

Specifically, they added a spheroidalization agent to a melt of cast iron of white cast iron ingredients, then cast it. The as-cast semi-finished product failed to show any particles of graphite in structure. Next, they hot rolled this cast semi-finished product at a relatively high temperature. The cast iron obtained shown a structure wherein particles of flattened graphite was dispersed. They learned from bending the cast iron that it was easily worked and was superior in vibration dampening and noise absorbing performance. They found that the particles of flattened graphite in the cast iron were covered over part or all of their outer surface with ferrite and that cast iron with a large ferrite phase is good in workability. The same results as the above were obtained for cast iron in the form of sheets, plates, rails, etc.

They suspended hot rolling in the middle and found that the rolled cast semi-finished product exhibited particles of spheroidal graphite and graphite reduced from the same in its structure and confirmed that the particles of flattened graphite observed in cast iron plate obtained by rolling are the result of the particles of the spheroidal graphite precipitated at the time of heating or rolling of the cast semi-finished product being flattened by rolling.

The present invention was made based on these discoveries. Below, the present invention will be explained in detail.

First, the cast iron of ingredients of white cast iron in which a large amount of particles of spheroidal graphite is dispersed according to the present invention will be explained. Incidentally, as the above "cast iron", rolled cast iron such as sheet cast iron, plate cast iron, and rail cast iron may be mentioned. "Rail cast iron" means bars, wire rods, rails, angles, I-sections, H-sections, and other sections, planks, etc. Further, cast iron obtained without rolling using a continuous casting machine with mold walls moving in synchronization with the cast semi-finished product may also be included under sheet cast iron. In the prior art, there has never been cast iron forming such properties. By obtaining cast iron with the properties like in the present invention, extremely good workability can be secured.

Below, sheet cast iron will be used as an example for the explanation.

Sheet cast iron is obtained by adding a spheroidalization agent to a melt of the white cast iron ingredients and casting the result to obtain a cast semi-finished product, rolling this cast semi-finished product, the heat treating it. Details of the method of production will be explained later.

In the particles of spheroidal graphite of the present invention, "spheroidal" does not necessarily mean a perfect sphere. The surface may be rough or parts may be flat as well.

Next, the ingredients of white cast iron will be explained. C and Si are the most important elements for obtaining white cast iron and have a large effect on the graphitization speed. If C and Si are, by wt %, (% C)≦4.3−(% Si)÷3 and C≧1.7%, preferably (% C)≦4.3−1.3x(% Si) and C≧1.7%, the result becomes white cast iron. Here, (% C) means the wt % of C in the white cast iron, while (% Si), means the wt % of Si in the white cast iron. If the content of C is less than 1.7 wt %, white cast iron cannot be obtained, so the range was made 1.7 wt % or more.

Further, to secure the workability, the density of the particles of the spheroidal graphite is preferably 50 particles/$mm^2$ or more. If the density of the particles of spheroidal graphite is less than 50 particles/$mm^2$, the workability deteriorates somewhat.

The size of the particles of the spheroidal graphite is not particularly limited, but usually is, in terms of circle equivalent diameter, 0.4 mm or less.

Further, to secure the workability, the amount of the ferrite covering the outside surfaces of the particles of graphite is preferably increased. The ratio of the ferrite in the cast iron is preferably 70% or more (volume basis), more preferably 80 to 90% or more (volume basis). With a ratio of the ferrite in the cast iron of less than 70% (volume basis), the workability drops somewhat.

Here, the ratio of the ferrite in the cast iron is obtained by finding the area rate of the ferrite at a cross-section of the cast iron. Further, this area rate can be found by image analysis etc.

Further, as the cast iron ingredients, at least one of Cr≧0.1 wt % and Ni≧0.1 wt % is preferably included. This is because inclusion of Cr or Ni enables control of the formation of particles of graphite at the time of production. That is, Cr suppresses the graphitization at the time of casting, while Ni acts to promote the graphitization at the time of heat treatment. However, if the content of Cr or Ni is less than 0.1 wt %, the effect is hard to obtain, so a content of Cr or Ni of 0.1 wt % or more is preferable. Further, the upper limit is not particularly set, but may be suitably set considering the cost, the workability required, etc.

The dispersed spheroidal graphite is complexly bonded with at least one type of particles of oxides, sulfides, nitrides, or their complex compounds of the elements of the spheroidalization agent. Here, the "spheroidalization agent" means the spheroidalization agents Fe—Si—Mg, Fe—Si—Mg—Ca, Fe—Si—Mg-REM, Ni—Mg, etc. used in the production of spheroidal graphite cast iron and is not particularly limited.

If the spheroidalization agent elements are present, the elements of the spheroidalization agent in the cast iron bond with the oxygen, sulfur, and nitrogen in the iron to form particles of oxides, sulfides, nitrides, and their complex compounds. These serve as nuclei for the formation of spheroidal graphite at the time of heat treatment after rolling, whereby particles of spheroidal graphite complexly bonded with at least one type of these particles are formed.

As specific elements for a spheroidalization agent, Mg, Ca, and a rare earth (REM) are preferable from the viewpoint of the effect of acceleration of spheroidization. Among these, Mg is particularly great in that effect, so is more preferable. Therefore, as the spheroidalization agent, a substance including Mg, Ca, or a rare earth (REM) is preferable.

The spheroidalization agent may be a single element or a mixture of a plurality of elements. Whatever the case, its effect is exhibited.

Next, the sheet of the present invention is comprised of a sheet of cast iron of the ingredients of white cast iron wherein at least one type of particles of oxides, sulfides, nitrides, or their complex compounds of elements of the spheroidalization agent are dispersed.

The sheet cast iron is obtained by adding a spheroidalization agent to a melt of the white cast iron ingredients and casting this to obtain a cast semi-finished product, then rolling this cast semi-finished product, that is, is sheet cast iron before any heat treatment after rolling. Details of its method of production will be explained later.

Since this sheet cast iron is not heat treated, no particles of spheroidal graphite are precipitated there. Therefore, this is a sheet of cast iron of the ingredients of white cast iron where at least one type of particles of oxides, sulfides, nitrides, or their complex compounds of elements of the spheroidalization agent are dispersed. The ingredients of white cast iron, the elements of the spheroidalization agent, and the actions of Cr and Ni are as explained above.

Further, if the density of the particles is less than 50 particles/$mm^2$, formation of particles of spheroidal graphite at the time of heat treatment becomes somewhat slow, the density of the particles of spheroidal graphite formed becomes somewhat small, and the spheroidal graphite becomes coarse, so the workability etc. are easily impaired. Therefore, the density of the number of particles is preferably 50 particles/$mm^2$ or more.

Further, if these particles are less than 0.05 μm in size, they will become hard to act as nuclei for particles of spheroidal graphite, while if they are over 5 μm, the particles of spheroidal graphite formed will become coarse and the workability etc. will easily be impaired, so the particles are preferably 0.05 μm to 5 μm in size. Here, the "size of the particles" means the circle equivalent diameter of the particles.

Further, the cast semi-finished product of the present invention, in the same way as the sheet not heat treated after rolling, is a cast semi-finished product of cast iron comprised of the ingredients of white cast iron wherein at least one type of particles of oxides, sulfides, nitrides, or their complex compounds of the spheroidalization agent elements are dispersed.

The cast semi-finished product is obtained by adding a spheroidalization agent to a melt of the white cast iron ingredients and casting this to a cast semi-finished product. Details of the method of production will be explained later. This cast semi-finished product, like the sheet not heat treated after rolling, has no particles of spheroidal graphite precipitated in it.

Therefore, this is a cast semi-finished product of cast iron of the ingredients of white cast iron where at least one type of particles of oxides, sulfides, nitrides, or their complex compounds of elements of the spheroidalization agent are dispersed. The ingredients of white cast iron, the elements of the spheroidalization agent, the actions of Cr and Ni, the density of the particles, the size of the particles, etc. are as explained above.

The cast semi-finished product may be produced by ingot casting or continuous casting, but graphite tends to more easily form the slower the cooling rate at the time of casting. It is therefore preferable to produce this by continuous casting using a water-cooled copper mold. In continuous casting, if the cast thickness becomes larger, the cooling rate at the center falls, so the thickness of the cast semi-finished product obtained by continuous casting is preferably 1 to 400 mm.

Specifically, when producing sheet, if producing it by a thin slab continuous casting machine, cast semi-finished products of a thickness of 30 to 120 mm or so are obtained. Further, if casting by a twin belt, short belt, twin drum, or short drum casting machine using belt, roll, or other moving molds, a cast semi-finished product of a thickness of 1 to 30 mm or so (which may be referred to as "sheets") is obtained.

Next, the method of production of cast semi-finished product of the present invention will be explained.

First, a spheroidalization agent is added to the melt of the white cast iron ingredients. The white cast iron ingredients are as explained above. Adding a spheroidalization agent, preferably at least one of Mg, Ca, and a REM, is effective in terms of accelerating spheroidization. The spheroidalization agent is usually added at the ladle, tundish, etc. Further, the amount of the spheroidalization agent added is not particularly limited so long as the final sheet product can be secured a good workability. It may be suitably set by advance studies etc., but usually is 0.02 wt % or so with respect to the molten iron.

Further, this molten iron preferably has at least one of Cr≧0.1 wt %, Ni≧0.1 wt % added to it. The Cr or Ni, like the above, is usually added at the ladle, tundish, etc.

By casting the thus obtained molten iron, the cast semi-finished product of the present invention is obtained. The casting method is not particularly limited so long as it has a cooling rate giving white cast iron over the entire material as cast. Further, the cooling rate is not particularly limited since it is affected by the casting conditions as well and may be suitably set. However, the faster the cooling rate, the easier he formation of white cast iron, so this is preferred.

Therefore, when producing this cast semi-finished product, a usual sand or other mold may be used for the casting, but particles of graphite tend to be more easily formed the slower the cooling rate, so production by a continuous casting machine with a relatively faster cooling rate is preferable. Further, using a continuous casting machine results in productivity rising and enables inexpensive production.

Note that the present invention is predicated on obtaining a white cast iron structure as cast. This is so as to prevent the particles of graphite formed by the primary crystals and eutectic crystals at the time of solidification from becoming coarser and obstructing crystal formation. Further, with particles of graphite formed at the time of casting, the state of formation of the particles of the graphite changes depending on the cooling rate, so the particles of graphite sometimes become uneven in size and number in the thickness direction. In particular, near the center of the thickness, there is a high possibility of coarse graphite being formed.

Further, if the cast semi-finished product already has particles of graphite present in it, when rolling the cast semi-finished product to produce iron sheet, the rolling will cause the particles of graphite to form thin flake shapes. These thin flake shaped particles of graphite will be distributed in layers, so the workability etc. will be impaired. Therefore, it is necessary that the cast semi-finished product not be formed with particles of graphite.

As opposed to this, according to the method of the present invention, a spheroidalization agent including elements such as Mg, Ca, and REM is added to the melt. By casting this, the obtained cast semi-finished product has no particles of graphite precipitated in it, but has particles of oxides, sulfides, nitrides, and their complex compounds of the elements of the spheroidalization agent bonded with the oxygen, sulfur, and nitrogen in the iron dispersed in it.

Further, in continuous casting of cast iron, normally a graphite or refractory mold has been used, but with this, the cooling rate is slow, so particles of graphite are easily produced. Also, the solidified shell is slow in growth, so casting of the white cast iron was difficult.

That is, if white cast iron is cast using a graphite mold used for continuous casting of usual cast iron, carbon dissolves out into the melt, so the mold is seriously damaged and long term casting becomes impossible. Further, white cast iron has a broad region of solid-liquid copresence, so with a graphite mold, the solidified shell becomes weak in strength, break out easily occurs, and therefore casting becomes difficult.

Therefore, by using a water-cooled copper mold, it becomes possible to increase the cooling rate and prevent the formation of particles of graphite in the cast semi-finished product. Further, by promoting the formation of the solidified shell, continuous casting stable over a long period of time becomes possible. The casting speed also can be increased as compared with use of graphite or refractory molds, so the productivity is improved.

Particles of graphite tend to become harder to form the faster the cooling rate at the time of casting. Therefore, to prevent the formation of particles of graphite, use of a continuous casting machine with a fast cooling rate is preferable. Specifically, it is preferable to use a continuous casting machine using a water-cooled copper mold as used in usual continuous casting of steel, preferably a thin slab continuous casting machine or a continuous casting machine with mold walls moving in synchronization with the cast semi-finished product.

The thickness of the cast semi-finished product obtained by casting by a slab or bloom continuous casting machine using a water-cooled copper mold used for usual continuous casting of steel is 120 to 400 mm or so, the thickness of the cast semi-finished product obtained by a thin slab continuous casting machine is 30 to 120 mm or so, and the thickness of a cast semi-finished product obtained by casting by a twin belt, short belt, twin drum, or short drum casting machine using belt, roll, or other moving molds (which may be referred to as "sheets") is 1 to 30 mm or so.

Further, when producing bar shaped products, they may be cast using continuous casting machines for billets having square or circular cross-sections. The cross-section of the cast semi-finished product at this time has a length of one side or diameter of the circle of 75 to 250 mm or so.

The cast semi-finished product produced by the method of the present invention, as explained above, does no have any particles of graphite formed in it. Therefore, it is possible to increase the reduction rate when hot rolling and, in some cases, cold rolling the cast semi-finished product.

Here, at the time of rolling, when producing sheet cast iron, the cast semi-finished product obtained by continuous casting or casting by a mold is heated in a heating oven or the hot cast semi-finished product is obtained as it is and hot rolled to a strip by a rough rolling machine and finish rolling machine. This is then coiled up by a coiler to obtain hot rolled sheet. In some cases, the coiled hot rolled sheet is uncoiled, pickled, then cold rolled by a cold rolling machine and again coiled to obtain cold rolled strip.

Further, in the same way, when producing plate cast iron, a cast semi-finished product cast by continuous casting or a mold is heated in a heating oven, then in accordance with need repeatedly rolled by a plate rolling machine in the length direction and width direction to obtain plate of predetermined dimensions, then cooled.

Further, when producing rail cast iron, the cast semi-finished product cast by the continuous casting or mold etc. is heated in a heating oven and rolled by rough rolling machine, intermediate rolling machine, and finish rolling machine having rolls of predetermined shapes to form bars, wire rods, rails, angles, I-sections, H-sections, and other sections which are then cut to predetermined lengths or coiled.

The rolled cast iron also does not have any particles of graphite precipitated in it. The state of the elements in the spheroidalization agent bonded with the oxygen, sulfur, and nitrogen in the iron to form particles of oxides, sulfides, nitrides, and their complex compounds dispersed in it is maintained.

Further, by heat treating the as-rolled cast iron obtained by the rolling and not having particles of graphite formed in it so as to form particles of spheroidal graphite, it becomes possible to produce spheroidal graphite cast iron without thin flake shaped particles of graphite distributed in it in layers.

In cast iron heat treated after rolling, the dispersed particles of the oxides, sulfides, nitrides, and their complex compounds of the elements of the spheroidalization agent bonded with the oxygen, sulfur, and nitrogen in the iron form nuclei for formation of particles of spheroidal graphite upon heat treatment, so the particles of graphite are uniformly dispersed and the number of particles is large and the size fine. By finely dispersing particles of spheroidal graphite in this way, cast iron with excellent workability is obtained. The hot rolling and cold rolling can be suitably selected according to the thickness or material of the product sought.

If there are no elements of the spheroidalization agent present, even with heat treatment after rolling, the particles of graphite will not be spheroidal graphite, but will be graphite masses or exploded graphite. The graphitization will also take a long time. As opposed to this, short-term heat treatment enables spheroidal graphitization.

Further, above, the method of heat treating cast iron as-cast was explained, but for example when a cast semi-finished product of a thickness of 1 to 30 mm or so obtained by casting by a twin belt, short belt, twin drum, or short drum casting machine using belt, roll, or other moving molds (also called a "sheet") does not have to be rolled, it may be heat treated without rolling.

At the time of hot rolling, if making the rolling temperature over 900° C., formation of particles of graphite will become easier, so 900° C. or less is preferable. By making the rolling temperature 900° C. or less, it is possible to more reliably obtain cast iron without particles of graphite formed in the sheet after rolling. Further, the same applies to the heating before rolling, that is, if making the heating temperature over 900° C., formation of particles of graphite will become easy, so 900° C. or less is preferable.

Next, the heat treatment temperature after rolling the cast iron will be explained. Here, this heat treatment is aimed at promoting spheroidal graphitization. With a heat treatment temperature of 900° C. or less, spheroidal graphitization takes a long time, so over 900° C. is preferable. The upper limit of the heat treatment temperature is not particularly set, but if the temperature is over 1150° C., the strength will fall and heat treatment strain will easily increase, so performing the heat treatment at 1150° C. or less is preferable.

Further, the heat treatment time after rolling of the cast iron will be explained. In the present invention, since the spheroidalization agent is added, spheroidal graphitization becomes possible in a short time. If heating for over 60 minutes, sometimes the particles of graphite end up becoming larger. When this is liable to happen, it is preferable to make the heat treatment time after rolling 60 minutes or less. According to the method of the present invention, even with 60 minutes or less of heat treatment, cast iron with fine particles of graphite uniformly dispersed in it can be obtained.

In the present invention, the particles of the graphite after heat treatment of the rolled cast iron or the thin cast semi-finished product etc. are covered with ferrite at part of all of their outside surfaces. If the cooling rate of this heat treatment is fast, the cast iron will end up being cooled before sufficient ferrite is formed and the amount of ferrite will become small.

Therefore, to increase the ratio of the ferrite in the cast iron, it is important to secure time for change to ferrite it is preferable, to hold the cast iron at 730 to 650° C. in the cooling process after the heat treatment, for example, it is preferable to hold it there for 30 minutes to 1 hour or so. Further, as another method, it is preferable to gradually cool the cast iron from 730° C. to 300° C. by the cooling process. It is preferable to make that cooling rate a cooling rate of 10° C./min or less. Further, both of these methods may be used.

Over 730° C., the stable presence of ferrite becomes hard, while less than 300° C., ferrite becomes hard to produce. Further, with a cooling rate over 10° C./min, the amount of ferrite easily falls.

Next, cast iron of ingredients of white cast iron wherein a large number of particles of flattened graphite is dispersed according to the present invention will be explained.

The numerous dispersed particles of flattened graphite are comprised of the particles of spheroidal graphite flattened by rolling, so the interfaces between the particles of graphite and the base iron are smooth and each particle is present independently.

In the prior art, there has never been cast iron forming such properties. By obtaining the cast iron of the properties like the present invention, good workability can be secured and further a good vibration dampening and noise absorbing performance can be secured.

If the particles of the flattened graphite become coarse, the workability is impaired, so the width of the particles of graphite is preferably 0.4 mm or less and the length 50 mm or less.

By having the particles of the flattened graphite in the cast iron covered at part or all of their outer circumferences by ferrite, the workability is further improved. Further, to secure the workability, the amount of the ferrite covering the outside surfaces of the particles of the graphite is preferably increased. The ratio of the ferrite in the cast iron is preferably 70% or more (volume basis), more preferably 80 to 90% or more (volume basis). If the ratio of the ferrite in the cast iron is less than 70% (volume basis), the workability declines somewhat. Here, the ratio of the ferrite in the cast iron is obtained by finding the area rate of the ferrite in a cross-section of the cast iron. Further, the area rate may be found by image analysis etc.

In the prior art, there has never been cast iron forming such properties. By obtaining cast iron of the properties like the present invention, good workability can be secured.

The above cast iron is obtained by adding a spheroidalization agent to a melt of white cast iron ingredients, casting the melt to obtain a cast semi-finished product, and hot rolling the cast semi-finished product. Details of the method of production will be explained later.

Further, the fact of the ingredients of the white cast iron forming composition satisfying, by wt %, $(\% C) \leqq 4.3-(\% Si) \div 3$ and $C \geqq 1.7\%$, preferably $(\% C) \leqq 4.3-1.3x(\% Si)$ and $C \geqq 1.7\%$ is the same as in the description of spheroidal graphite cast iron.

Further, inclusion at least one of $Cr \geqq 0.1$ wt % and $Ni \geqq 0.1$ wt % as ingredients of the cast iron is preferable in the same way as described for spheroidal graphite cast iron.

The dispersed particles of the flattened graphite are complexly bonded with at least one type of particles of oxides, sulfides, nitrides, or their complex compounds of the elements of the spheroidalization agent. Here, the "spheroidalization agent" means the spheroidalization agents Fe—Si—Mg, Fe—Si—Mg—Ca, Fe—Si—Mg-REM, Ni—Mg, etc. used in the production of spheroidal graphite cast iron and is not particularly limited.

If there are elements of the spheroidalization agent present; in the cast iron, the elements in the dispersed spheroidalization agent bond with the oxygen, sulfur, and nitrogen in the iron to produce oxides, sulfides, nitrides, and their complex compounds. This form the nuclei for the precipitation of particles of graphite at the time of heating before rolling and rolling, whereby particles of graphite complexly bonded with at least one type of these particles are formed. The particles of graphite complexly bonded with these particles are flattened at the time of rolling.

As specific elements of the spheroidalization agent, Mg, Ca, and rare earths (REM) are preferable in terms of the effect of acceleration of spheroidization. Among these, Mg is particularly great in effect, so is more preferable. Therefore, as a spheroidalization agent, a substance containing Mg, Ca, or a rare earth (REM) is preferable.

The spheroidalization agent may be a single element or a mixture of a plurality of elements. Whichever the case, its effect is exhibited.

Further, even for cast iron with particles of flattened graphite dispersed in it, the properties of the cast semi-finished product obtained by casting the melt and the method of production of the cast semi-finished product are similar to those of cast iron with particles of spheroidal graphite dispersed in it.

The cast semi-finished product produced by the method of the present invention, as explained above, is not formed with particles of graphite in it, but particles of graphite are later formed by suitably heating before rolling or heating after rolling, so it is possible to obtain strength enabling reduction under rolling, enable hot rolling, and obtain various types of cast iron.

That is, at the time of heating and hot rolling, the elements in the dispersed spheroidalization agent bond with the oxygen, sulfur, and nitrogen in the iron to produce oxides, sulfides, nitrides, and their complex compounds. These particles serve as the nuclei for the formation of particles of spheroidal graphite, so the particles of the graphite are uniformly dispersed, large in number, and fine in size. Since particles of spheroidal graphite are finely dispersed in this way, hot rolling becomes easy.

Further, the rolled cast iron has particles of flattened graphite dispersed in it. These are not connected together, but are independently present. Further, the interfaces between the particles of graphite and base iron are smooth. By dispersing particles of flattened graphite in this way, cast iron excellent in workability is obtained. Any subsequent cold rolling may be suitably selected in accordance with the thickness and material of the product sought.

If there were no elements of the spheroidalization agent element, at the time of rolling, the particles of graphite would not become particles of spheroidal graphite, but would form graphite masses or exploded graphite and the interfaces between the particles of graphite flattened at the time of rolling and the base iron would become rough or net-like, so cracking would occur at the time of hot rolling and therefore the workability etc. of the rolled sheet would be impaired.

At the time of hot rolling, when the heating temperature before rolling and the rolling temperature are 900° C. or less, formation of particles of graphite becomes difficult, so over 900° C. is preferable. By making the heating before rolling and the rolling temperature more than 900° C., at the time of heating before rolling and at the time of rolling, formation of particles of graphite becomes easy and particles of flattened graphite are finely dispersed in the cast iron obtained. Here, the upper limits of the heating temperature before rolling and the rolling temperature are not particularly limited and may be suitably set, but usually these operations can be performed at the melting point of iron, that is, 1150° C., or less.

Having the particles of the flattened graphite in the cast iron covering by ferrite at part or all of their circumferences further improves the workability. Further, to secure the workability, it is preferable to increase the amount of the ferrite covering the outside surfaces of the particles of the graphite. Making the area rate of the ferrite in a cross-section 70% or more is preferable as explained earlier.

If the cooling rate after the hot rolling is fast, the cast iron will end up cooling before sufficient ferrite is formed and therefore the amount of ferrite will become smaller. Therefore, to increase the ratio of the ferrite in the cast iron, securing time for changing to ferrite after the hot rolling is important. Holding the cast iron once at 730 to 650° C. in the cooling process after the hot rolling is preferable. For example, holding it there for 30 minutes to 1 hour or so is preferable. Further, as another method, it is preferable to gradually cool the cast iron in the interval between 730° C. to 300° C. in the cooling process. The cooling rate is preferably made a cooling rate of 10° C./min or less. Further, both of these methods may also be used.

Over 730° C., stable presence of ferrite becomes difficult, while if less than 300° C., ferrite becomes hard to form. Further, with a cooling rate over 10° C./min, the amount of ferrite is easily reduced.

When the hot rolled cast iron is sheet, it may be taken up in a coil. To increase the amount of ferrite at this time, coiling at a temperature of 750 to 550° C. is preferable since it allows gradual cooling. The cooling rate in this case usually can be made 10° C./min or less.

Over 750° C., finishing the rolling and coiling easily become difficult. On the other hand, if coiling at less than 550° C., the amount of ferrite easily is reduced.

Further, the cast iron with the particles of flattened graphite dispersed in it obtained by hot rolling as explained above may be further cold rolled in accordance with need.

Particles of flattened graphite easily absorb vibration, so compared with spheroidal graphite cast iron, it becomes possible to produce cast iron more superior in dampening vibration and absorbing sound.

EXAMPLES

Example 1

The chemical ingredients of each of the cast irons shown in Table 1 were melted in a melting furnace, a spheroidalization agent was added, then the melt was cast into a 100 mm square mold. The white cast iron was hot rolled to obtain a 3.5 mm thick hot rolled sheet. Part of the hot rolled sheet was further cold rolled to obtain a 1.2 mm thick cold rolled strip. Parts of the hot rolled sheet and cold rolled strip obtained by rolling the white cast iron were heat treated in a heating oven. After the end of the heating, these were cooled to room temperature over a predetermined temperature history.

On the other hand, the comparative examples are examples of use of conventional technology. Specifically, in Comparative Example 1, an ordinary spheroidal graphite cast iron melt was cast and the obtained cast semi-finished product hot rolled. Further, in Comparative Example 2, cast iron melt of a white cast iron ingredient system was cast without adding any spheroidalization agent, and the obtained cast semi-finished product was hot rolled, cold rolled, then heat treated after rolling.

Samples of the obtained cast semi-finished products, hot rolled sheets, cold rolled strips, and heat treated sheets were taken and examined for composition of the precipitates by SEM-EDX and for the number of precipitates by SEM. Further, the form and number of the graphite particles were examined by an optical microscope. In addition, each sheet product was corroded by a Nytal corrosive solution to expose the metal structure which was then examined under an optical microscope to measure the ferrite area rate (sometimes referred to as the "ferrite rate"). These results are summarized in Table 2 and Table 3. Example No. 1a to No. 17a are examples of sheets of cast iron comprised of white cast iron where particles of spheroidal graphite are dispersed, while Example No. 1b to No. 17b are examples of sheets of cast iron comprised of white cast iron where particles of flattened graphite are dispersed.

Samples of the obtained cast semi-finished products, hot rolled sheets, cold rolled strips, and heat treated sheets were taken and examined for composition of the precipitates by SEM-EDX and for the number of precipitates by SEM. Further, the form and number of the graphite particles were examined by an optical microscope. In addition, each sheet product was corroded by a nital corrosive solution to expose the metal structure which was then examined under an optical microscope to measure the ferrite area rate (sometimes referred to as the "ferrite rate"). These results are summarized in Table 2 and Table 3. Example No. 1a to No. 17a are examples of sheets of cast iron comprised of white cast iron where particles of spheroidal graphite are dispersed, while Example No. 1b to No. 17b are examples of sheets of cast iron comprised of white cast iron where particles of flattened graphite are dispersed.

On the other hand, in Comparative Example 1, edge cracking occurred at the time of hot rolling and the shape of the sheet was poor. The obtained sheet ended up cracking with bending. In Comparative Example 2, cracking occurred at the time of bending.

Figure 1B:
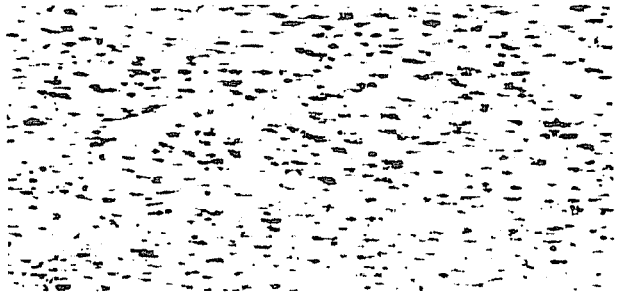
Figure 1C:
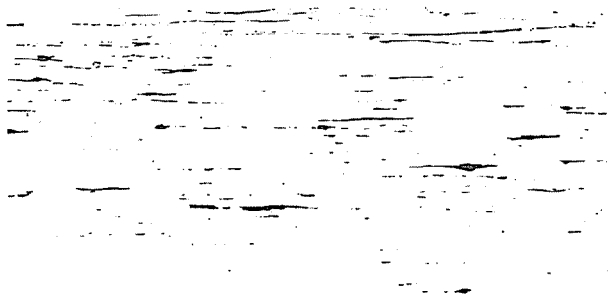

Further, FIG. 1 shows examples of photographs of the metal structure of the test samples, wherein FIG. 1(*a*) shows the metal structure of Invention Example No. 1a, FIG. 1(*b*) the structure of Invention Example No. 1b, and FIG. 1(*c*) the structure of Comparative Example No. 1. From FIG. 1, in Invention Example No. 1a, the particles of graphite are spheroidal in shape, while in Invention Example No. 1b, the particles of graphite are flattened. As opposed to this, in Comparative Example No. 1, the particles of graphite form thin flake shapes present in layers.

Figure 2A:
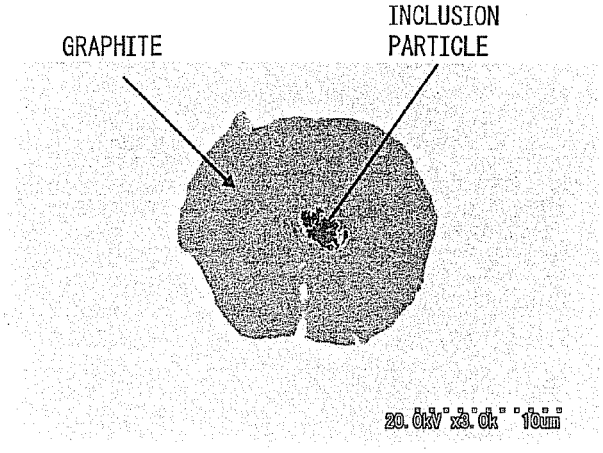
FIG. 2 gives enlarged photographs of the graphite in the sheet products according to examples of the present invention, wherein FIG. 2(*a*) is an enlarged photograph of the graphite of Invention Example No. 1a and FIG. 2(*b*) the graphite of Invention Example No. 1b.
Figure 2B:
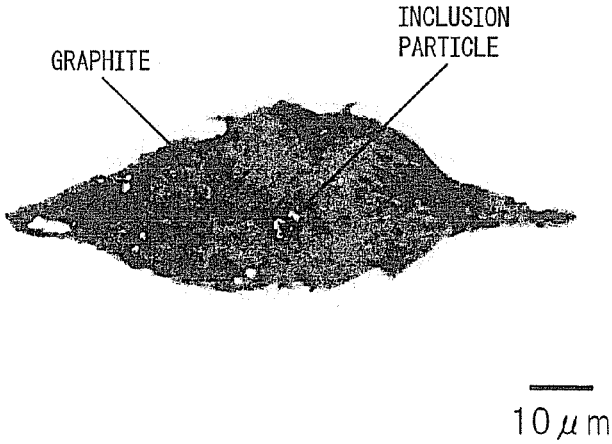

Further, FIG. 2 shows examples of enlarged photographs of particles of graphite of the invention examples. FIG. 2(*a*) shows a particle of spheroidal graphite of No. 1a, while FIG. 2(*b*) shows a particle of flattened graphite of No. 1b. Near the center of each graphite particle, there is an inclusion. This served as the nucleus for formation of the graphite particle. Further, the fact that the inclusion near the center of the graphite was Mg—O—S was confirmed by an SEM.

Figure 3A:
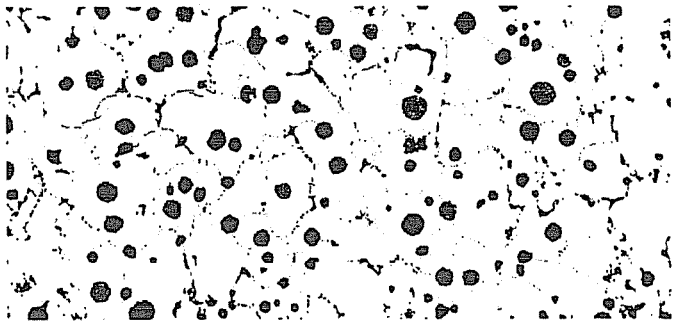
FIG. 3 gives photographs of the metal structures of sheet products according to examples of the present invention after nital corrosion, wherein FIG. 3(*a*) is a photograph showing the metal structure of Invention Example No. 1a, FIG. 3(*b*) the metal structure of Invention Example No. 1b, and FIG. 3(*c*) the metal structure of Invention Example No. 2b.
Figure 3B:
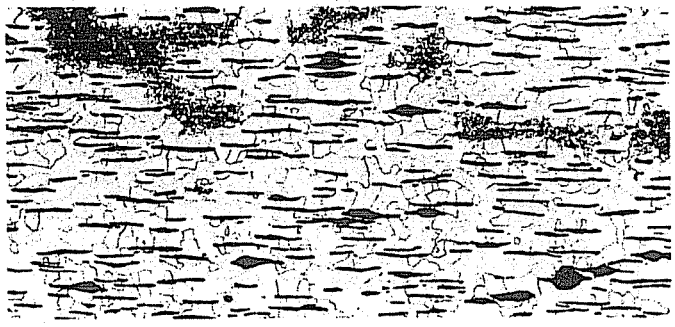
Figure 3C:
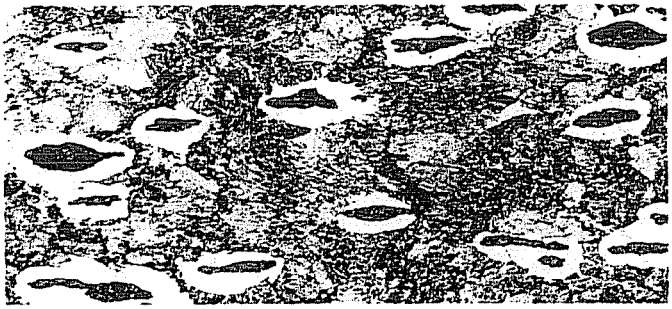

Further, FIG. 3 shows examples of photographs of the metal structures of the test samples after corrosion by a nital corrosive solution, wherein FIG. 3(*a*) shows the metal structure of Invention Example No. 1a, FIG. 3(*b*) that of Invention Example No. 1b, and FIG. 3(*c*) that of Example 2b. From FIG. 3, in Invention Example No. 1a, the particles of spheroidal graphite are covered by ferrite over substantially their entire circumferences, while in Invention Example No. 1b, the particles of flattened graphite are covered by ferrite over substantially their entire circumference. As opposed to this, in Example 2b, the ferrite area rate is low. There are particles of flattened graphite covered by ferrite over their entire circumferences and particles of flattened graphite covered by ferrite over their circumferences only partially all mixed together. In either case, the particles of graphite were covered by ferrite over their circumferences, and workability was secured.

Example 2

Figure 4:
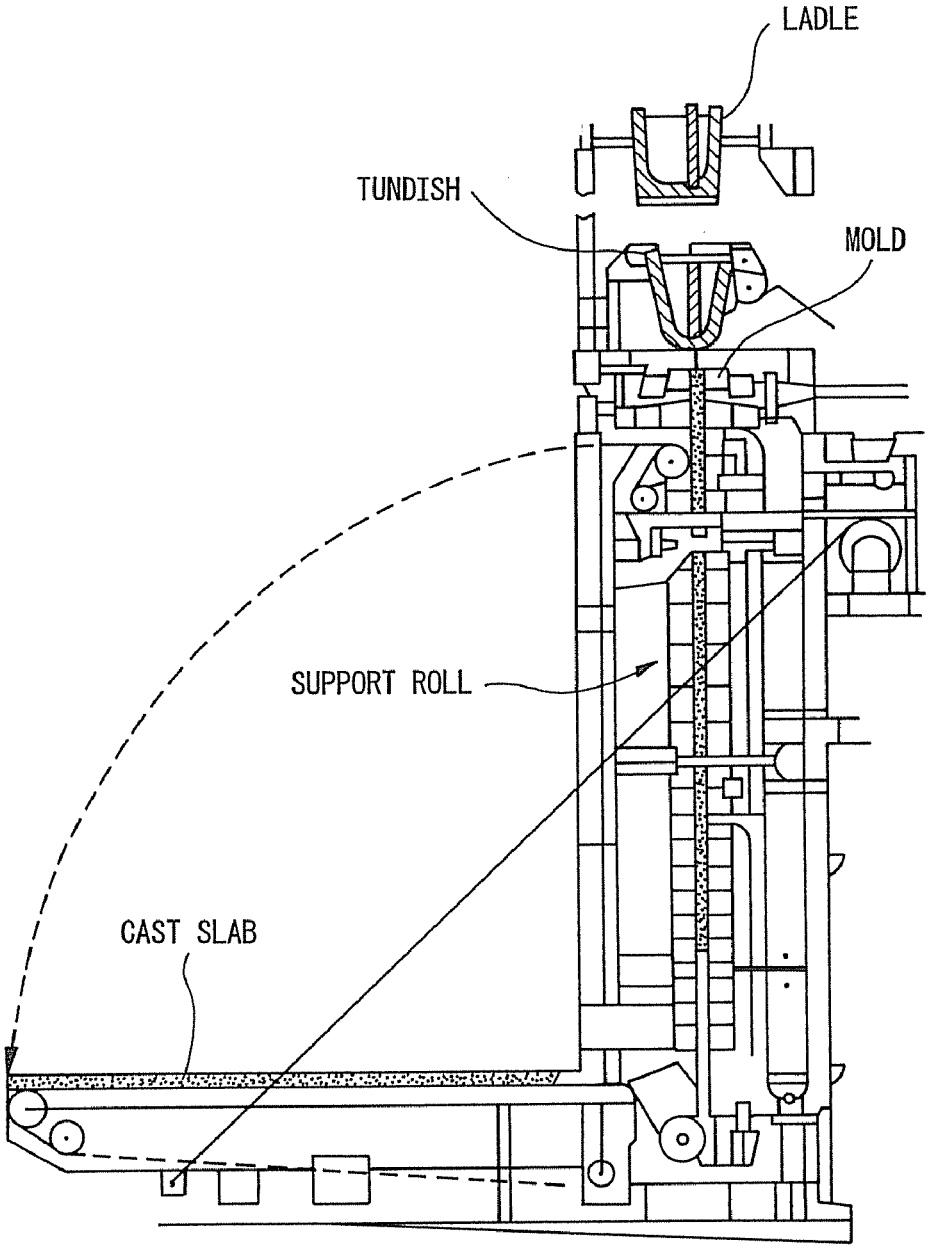
FIG. 4 is a view of a continuous casting machine according to an embodiment of the present invention.

A C: 3.4 wt % and Si: 0.3 wt % cast iron melt was charged with an Ni—Mg spheroidalization agent to Mg: 0.03 wt %, then was continuously cast by a vertical continuous casting machine using a water-cooled copper mold via a tundish to a slab of a thickness of 200 mm and a width of 1000 mm so as to produce a cast semi-finished product. FIG. 4 shows an outline of the continuous casting machine.

Part of this cast semi-finished product was hot rolled at 850° C. to obtain a 3 mm thick hot rolled sheet. Further, part of the hot rolled sheet was cold rolled to obtain a 1 mm thick cold rolled strip. The thus obtained hot rolled sheet and cold rolled strip were heated in a heating oven at 1000° C. for 30 minutes. After the end of the heating, they were allowed to cool to room temperature. Samples were taken from the obtained cast semi-finished product, hot rolled sheet, cold rolled strip, and heat treated sheets and examined for the form and distribution of the particles of graphite.

As a result, the cast semi-finished product and sheet before heat treatment exhibited particles of Mg oxides and sulfides and combinations of these of 0.1 to 3 μm or so size, but no particles of graphite could be observed. On the other hand, the sheets after heat treatment revealed particles of spheroidal graphite both for the hot rolled sheet and cold rolled strip. The number of these particles of spheroidal graphite was approximately 100 particles/$mm^2$ showing that a large number of fine particles were dispersed. Further, the particles observed before heat treatment were present inside these particles of spheroidal graphite.

Further, another part of the cast semi-finished product was hot rolled at 950° C. to obtain a 3 mm thick hot rolled sheet which was then coiled at a temperature of 600° C. Further, part of the hot rolled sheet was cold rolled to a 1 mm thick cold rolled strip. Samples of the obtained cast semi-finished product, hot rolled sheet, and cold rolled strip were taken and examined for the form and distribution of the particles of graphite.

In the cast semi-finished product, particles of Mg oxides and sulfides and combinations of the same of 0.1 to 3 μm or so size were observed, but no particles of graphite could be observed. In the sheets after rolling, the state of particles of flattened graphite dispersed could be observed for both the hot rolled sheet and cold rolled strip. The number of particles of the spheroidal graphite was approximately 100 particles/$mm^2$ showing that a large number of fine particles were dispersed. Further, the particles observed inside the cast semi-finished product were present inside the particles of graphite. Further, the particles of graphite were covered by ferrite at their circumferences. The area rate of the ferrite was 98%.

Example 3

A C: 2.4 wt % and Si: 0.7 wt % cast iron melt was charged with a Ca—Si spheroidalization agent to Ca: 0.005 wt % and Si: 1.0 wt %, then was continuously cast by a vertical thin slab casting machine using a water-cooled copper mold via a tundish to a slab of a thickness of 50 mm and a width of 900 mm.

Part of this cast semi-finished product was hot rolled at 800° C. to obtain a 3.5 mm thick hot rolled sheet which was then coiled up. Further, part of the hot rolled sheet was cold rolled to obtain a 1.5 mm thick cold rolled strip. The thus obtained hot rolled sheet and cold rolled strip were heated in a heating oven at 1000° C. for 30 minutes. After the end of the heating, they were cooled from 700° C. to 300° C. by a cooling rate of 1° C./min, then were allowed to cool to room temperature. Samples were taken from the obtained cast semi-finished product, hot rolled sheet, cold rolled strip, and heat treated sheets and examined for the form and distribution of the particles of graphite.

As a result, the cast semi-finished product and sheet before heat treatment exhibited particles of Ca oxides and sulfides and combinations of these of 0.5 to 5 μm or so size, but no particles of graphite could be observed. On the other hand, the sheets after heat treatment revealed particles of spheroidal graphite both for the hot rolled sheet and cold rolled strip. The number of these particles of spheroidal graphite was approximately 150 particles/$mm^2$ showing that a large number of fine particles were dispersed. Further, the particles observed before heat treatment were present inside these particles of spheroidal graphite. Further, the particles of graphite were covered by ferrite at their circumferences. The area rate of the ferrite was 75%.

Further, another part of the cast semi-finished product was hot rolled at 1000° C. to obtain a 3.5 mm thick hot rolled sheet which was then coiled at a coiling temperature of 730° C. Further, part of the hot rolled sheet was cold rolled to a 1.5 mm thick cold rolled strip. Samples of the obtained cast semi-finished product, hot rolled sheet, and cold rolled strip were taken and examined for the form and distribution of the particles of graphite.

In the cast semi-finished product, particles of Ca oxides and sulfides and combinations of the same of 0.5 to 4 μm or so size were observed, but no particles of graphite could be observed. In the sheets after rolling, the state of particles of flattened graphite dispersed could be observed for both the hot rolled sheet and cold rolled strip. The number of particles of the flattened graphite was approximately 150 particles/$mm^2$ showing that a large number of fine particles were dispersed. Further, the particles observed inside the cast semi-finished product were present inside the particles of graphite. Further, the particles of graphite were covered by ferrite at their circumferences. The area rate of the ferrite was 95%.

Example 4

A C: 3.0 wt % and Si: 0.6 wt % cast iron melt was charged with a REM-based spheroidalization agent to REM: 0.01 wt %, then was cast by a twin-drum continuous casting machine with a drum diameter of 1000 mm to a sheet of a thickness of 3 mm. Part of this sheet was cold rolled to obtain a 1.0 mm thick cold rolled strip. The as-cast sheet and cold rolled strip were heated in a heating oven at 950° C. for 45 minutes. After the end of the heating, they were allowed to cool to room temperature. Samples were taken from the obtained cast semi-finished product, cold rolled strip, and heat treated sheets and examined for the form and distribution of the particles of graphite.

As a result, the cast semi-finished product and sheets before heat treatment exhibited particles of REM oxides and sulfides and combinations of these of 0.1 to 3 μm or so size, but no particles of graphite could be observed. On the other hand, the sheets after heat treatment revealed particles of spheroidal graphite both for the hot rolled sheet and cold rolled strip. The number of these particles of spheroidal graphite was approximately 200 particles/$mm^2$ showing that a large number of fine particles were dispersed. Further, the particles observed before heat treatment were present inside these particles of spheroidal graphite. Further, the particles of graphite were covered by ferrite at their circumferences.

Example 5

A C: 3.0 wt % and Si: 0.6 wt % cast iron melt was charged with a REM-based spheroidalization agent to REM: 0.01 wt %, then was cast by a twin-drum continuous casting machine with a drum diameter of 1000 mm to a sheet of a thickness of 3 mm. This was rolled to a thickness of 2.4 mm by an in-line rolling machine. Further, the rolling temperature was made 950° C. Part of this sheet was cold rolled to obtain a 1.0 mm thick cold rolled strip. Samples were taken from the obtained hot rolled sheet and cold rolled strip and examined for the form and distribution of the particles of graphite.

Both the hot rolled sheet and the cold rolled strip exhibited particles of flattened graphite. A large number of particles of flattened graphite were dispersed. Further, they were of a size of a width of 0.01 mm to 0.3 mm and a length of 0.02 mm to 30 mm. Further, particles of REM oxides and sulfides and combinations of the same of 0.05 to 3 μm or so size were observed inside the particles of the flattened graphite.

Example 6

A C: 3.4 wt % and Si: 0.3 wt % cast iron melt was charged with an Ni—Mg spheroidalization agent to Mg: 0.03 wt %, then was continuously cast by a vertical continuous casting machine using a water-cooled copper mold via a tundish to a slab of a thickness of 250 mm and a width of 1500 mm so as to produce a cast semi-finished product. FIG. 4 shows an outline of the continuous casting machine.

Part of this cast semi-finished product was hot rolled at 850° C. to obtain a 40 mm thick hot rolled sheet. The thus obtained hot rolled sheet was heated in a heating oven at 1000° C. for 30 minutes. After the end of the heating, it was allowed to cool to room temperature. Samples were taken from the obtained cast semi-finished product, hot rolled sheet, and heat treated sheet and examined for the form and distribution of the particles of graphite.

As a result, the cast semi-finished product and sheet before heat treatment exhibited particles of Mg oxides and sulfides and combinations of these of 0.1 to 3 μm or so size, but no particles of graphite could be observed. On the other hand, the sheet after heat treatment revealed particles of spheroidal graphite. The number of these particles of spheroidal graphite was approximately 180 particles/$mm^2$ showing that a large number of fine particles were dispersed. Further, the particles observed before heat treatment were present inside these particles of spheroidal graphite.

Further, another part of the cast semi-finished product was hot rolled at 950° C. to obtain a 40 mm thick hot rolled sheet. Samples of the obtained cast semi-finished product and hot rolled sheet were taken and examined for the form and distribution of the particles of graphite.

In the cast semi-finished product, particles of Mg oxides and sulfides and combinations of the same of 0.1 to 3 μm or so size were observed, but no particles of graphite could be observed. In the sheet after rolling, the state of particles of flattened graphite dispersed could be observed. The number of particles of the spheroidal graphite was approximately 180 particles/$mm^2$ showing that a large number of fine particles were dispersed. Further, the particles observed inside the cast semi-finished product were present inside the particles of graphite.

Example 7

A C: 2.4 wt % and Si: 1.0 wt % cast iron melt was charged with an Ni—Mg spheroidalization agent to Mg: 0.03 wt %, then was continuously cast by a curved continuous casting machine with an arc radius of 10.5 m using a water-cooled copper mold via a tundish to a billet of 160 mm square so as to produce a cast semi-finished product.

Part of this cast semi-finished product was hot rolled at 850° C. to obtain a 20 mm diameter bar. The thus obtained cast iron bar was heated in a heating oven at 1000° C. for 30 minutes. After the end of the heating, it was allowed to cool to room temperature. Samples were taken from the obtained cast semi-finished product, iron bar, and heat treated cast iron bar and examined for the form and distribution of the particles of graphite.

As a result, the cast semi-finished product and cast iron bar before heat treatment exhibited particles of Mg oxides and sulfides and combinations of these of 0.1 to 3 μm or so size, but no particles of graphite could be observed. On the other hand, the bar after heat treatment revealed particles of spheroidal graphite. The number of these particles of spheroidal graphite was approximately 180 particles/mm$^2$ showing that a large number of fine particles were dispersed. Further, the particles observed before heat treatment were present inside these particles of spheroidal graphite.

Further, another part of the cast semi-finished product was hot rolled at 950° C. to obtain a 15 mm thick hot rolled sheet. Samples of the obtained cast semi-finished product and cast iron bar were taken and examined for the form and distribution of the particles of graphite.

In the cast semi-finished product, as explained above, particles of Mg oxides and sulfides and combinations of the same of 0.1 to 3 μm or so size were observed, but no particles of graphite could be observed. In the cast iron bar, the state of particles of flattened graphite dispersed could be observed. The number of particles of the flattened graphite was approximately 180 particles/mm$^2$ showing that a large number of fine particles were dispersed. Further, the particles observed inside the cast semi-finished product were present inside the particles of graphite.

INDUSTRIAL APPLICABILITY

According to the rolled cast iron, sheet cast iron, and method of production of the present invention, rolled cast iron can be produced without heat treatment requiring massive heat energy and long time. Due to this, it becomes possible to obtain cast iron plate, cast iron sheet, cast iron rails, etc. excellent in workability and possible to provide various products using the same. That is, it becomes possible to provide a steel cast semi-finished product with little energy consumption and little emission of $CO_2$, that is, low environmental load.

TABLE 1

| | No. | C (%) | Si (%) | 4.3-(% Si)/3 (%) | 4.3-1.3(% Si) (%) | Cr (%) | Ni (%) | Mg (%) | Ca (%) | REM (%) | Type of spheroidalization agent |
|---|---|---|---|---|---|---|---|---|---|---|---|
| INVENTION | 1 | 1.8 | 1.8 | 4.9 | 2 | — | — | 0.01 | — | — | Fe—Si—Mg |
| | 2 | 2.0 | 1.5 | 3.8 | 2.4 | — | — | — | 0.01 | — | Ca—Si |
| | 3 | 2.5 | 1.2 | 4.7 | 2.7 | — | — | — | — | 0.005 | Fe-REM |
| | 4 | 3.0 | 0.9 | 4 | 3.1 | — | — | 0.06 | — | — | Fe—Mg |
| | 5 | 3.5 | 0.3 | 4.2 | 3.9 | — | — | 0.02 | 0.003 | — | Fe—Si—Ca—Mg |
| | 6 | 3.7 | 0.4 | 4.2 | 3.8 | — | — | 0.03 | — | 0.1 | Fe—Si—Mg-REM |
| | 7 | 3.0 | 0.5 | 4.1 | 3.7 | 0.1 | — | — | — | 0.05 | Misch metal |
| | 8 | 2.5 | 0.5 | 4.1 | 3.7 | 10.0 | — | — | 0.005 | — | Ca—Si |
| | 9 | 3.5 | 0.3 | 4.2 | 3.9 | — | 0.1 | 0.04 | 0.006 | — | Fe—Si—Mg—Ca |
| | 10 | 3.0 | 0.01 | 4.29 | 4.29 | — | 3.5 | 0.03 | — | — | Ni—Mg |
| | 11 | 2.5 | 0.9 | 4 | 3.1 | 3.5 | 1.0 | 0.05 | — | 0.05 | Fe—Si—Mg-REM |
| | 12 | 3.7 | 0.2 | 4.2 | 4 | — | — | 0.03 | — | 0.1 | Fe—Si—Mg-REM |
| | 13 | 3.5 | 0.3 | 4.2 | 3.9 | — | 0.1 | 0.04 | 0.006 | — | Fe—Si—Mg—Ca |
| | 14 | 2.5 | 2.0 | 3.6 | 1.7 | — | 0.3 | 0.02 | — | — | Ni—Mg |
| | 15 | 3.0 | 3.5 | 3.1 | −0.3 | — | — | — | — | 0.02 | Misch metal |
| | 16 | 3.0 | 2.0 | 3.6 | 1.7 | — | — | — | — | — | Fe—Si—Mg |
| | 17 | 3.5 | 0.7 | 4.1 | 3.4 | — | — | 0.04 | 0.004 | — | Fe—Si—Ca—Mg |
| COMP | 1 | 3.6 | 2.5 | 3.5 | 1.1 | — | — | 0.03 | — | — | Fe—Si—Mg |
| | 2 | 2.5 | 0.5 | 4.1 | 3.7 | — | — | — | — | — | — |

(% marks all mean "wt %")

TABLE 2

| | No. | Hot roll. temp. (° C.) | Cold roll. | Heat treat. temp. (° C.) | Heat treat. time (min) | Holding temp. after heat treat. (° C.) | Cooling rate after heat treat. (° C./min) | Product | Billet: Graphite: Present | Form | Density (/mm$^2$) | No. of inclusions: Type | Density* (/mm$^2$) |
|---|---|---|---|---|---|---|---|---|---|---|---|---|---|
| INVENTION | 1a | 900 | No | 910 | 60 | | 3 | Hot rolled sheet | No | — | | Mg—O—S | 180 |
| | 2a | 850 | Yes | 1000 | 20 | 650 | 5 | Cold rolled strip | No | — | | Ca—O—S | 60 |
| | 3a | 800 | Yes | 950 | 40 | | 8 | Cold rolled strip | No | — | | REM-O—S | 150 |
| | 4a | 820 | No | 905 | 60 | | 2 | Hot rolled sheet | No | — | | Mg—O—S | 1000 |
| | 5a | 780 | No | 960 | 30 | | 0.2 | Hot rolled sheet | No | — | | Mg—O—S<br>Ca—O—S | 250 |
| | 6a | 900 | Yes | 1000 | 30 | | 1 | Cold rolled strip | No | — | | Mg—O—S<br>REM-O—S | 500 |
| | 7a | 820 | Yes | 910 | 40 | 730 | 20 | Cold rolled strip | No | — | | REM-O—S | 150 |

TABLE 2-continued

| | | | | | | | | | | | | | |
|---|---|---|---|---|---|---|---|---|---|---|---|---|---|
| | 8a | 850 | No | 950 | 25 | | 5 | Hot rolled sheet | No | — | | Ca—O—S | 60 |
| | 9a | 850 | No | 930 | 50 | | 8 | Hot rolled sheet | No | — | | Mg—O—S<br>Ca—O—S | 220 |
| | 10a | 750 | Yes | 1000 | 5 | | 10 | Cold rolled strip | No | — | | Mg—O—S | 180 |
| | 11a | 840 | No | 1050 | 10 | | 30 | Hot rolled sheet | No | — | | Mg—O—S<br>REM-O—S | 300 |
| | 12a | 900 | Yes | 1000 | 30 | | 5 | Cold rolled strip | No | — | | Mg—O—S<br>REM-O—S | 150 |
| | 13a | 850 | No | 800 | 90 | 700 | 1 | Hot rolled sheet | No | — | | Mg—O—S<br>Ca—O—S | 250 |
| | 14a | 900 | No | 950 | 60 | — | 2 | Hot rolled sheet | No | — | | Mg—O—S | 800 |
| | 15a | 800 | No | 1050 | 5 | — | 0.1 | Hot rolled sheet | No | — | | REM-O—S | 120 |
| | 16a | 850 | Yes | 1000 | 30 | 700 | 10 | Cold rolled strip | No | — | | Mg—O—S | 300 |
| | 17a | 790 | No | 910 | 20 | — | 5 | Hot rolled sheet | No | — | | Mg—O—S<br>Ca—O—S | 450 |
| COMP | 1 | 900 | No | — | — | — | — | Hot rolled sheet | Yes | Spheroid | 800 | Mg—O—S | 90 |
| | 2 | 900 | Yes | 1000 | 60 | — | 20 | Cold rolled strip | No | — | | — | |

| | | Product sheet | | | | | | | |
|---|---|---|---|---|---|---|---|---|---|
| | | Graphite | | | Inclusions | | | | |
| | No. | Present | Form | No. | Type | Density* (/mm$^2$) | State | Ferrite rate (%) | Workability |
| INVENTION | 1a | Yes | Sphere | 100 | Mg—O—S | 180 | In graphite | 95 | 1 |
| | 2a | Yes | Sphere | 50 | Ca—O—S | 60 | In graphite | 80 | 2 |
| | 3a | Yes | Sphere | 120 | REM-O—S | 150 | In graphite | 55 | 2 |
| | 4a | Yes | Sphere | 900 | Mg—O—S | 1000 | In graphite | 80 | 1 |
| | 5a | Yes | Sphere | 240 | Mg—O—S<br>Ca—O—S | 250 | In graphite | 100 | 1 |
| | 6a | Yes | Sphere | 400 | Mg—O—S<br>REM-O—S | 500 | In graphite | 90 | 1 |
| | 7a | Yes | Sphere | 110 | REM-O—S | 150 | In graphite | 60 | 2 |
| | 8a | Yes | Sphere | 50 | Ca—O—S | 60 | In graphite | 65 | 2 |
| | 9a | Yes | Sphere | 200 | Mg—O—S<br>Ca—O—S | 220 | In graphite | 30 | 3 |
| | 10a | Yes | Sphere | 150 | Mg—O—S | 180 | In graphite | 55 | 3 |
| | 11a | Yes | Sphere | 250 | Mg—O—S<br>REM-O—S | 300 | In graphite | 5 | 3 |
| | 12a | Yes | Sphere | 100 | Mg—O—S<br>REM-O—S | 150 | In graphite | 75 | 2 |
| | 13a | Yes | Sphere | 220 | Mg—O—S<br>Ca—O—S | 250 | In graphite | 100 | 1 |
| | 14a | Yes | Sphere | 400 | Mg—O—S | 800 | In graphite | 95 | 1 |
| | 15a | Yes | Sphere | 100 | REM-O—S | 120 | In graphite | 100 | 1 |
| | 16a | Yes | Sphere | 250 | Mg—O—S | 300 | In graphite | 85 | 2 |
| | 17a | Yes | Sphere | 300 | Mg—O—S<br>Ca—O—S | 450 | In graphite | 90 | 1 |
| Comp. Ex. | 1 | Yes | Layer | 80 | Mg—O—S | 90 | In graphite | 0 | 4 |
| | 2 | No | | | — | | | 0 | 4 |

*"No. of inclusions" is number of size of 0.05 to 5 μm,

**"Workability" is evaluated by bending test scored as 1: excellent, 2: good, 3: fair, 4: poor.

TABLE 3

| | | | | | | | Billet | | |
|---|---|---|---|---|---|---|---|---|---|
| | | | | Cooling | | | | Inclusions | |
| | No. | Hot rolling temp. (° C.) | Holding temp. (° C.) | rate (° C./min) | Cold rolling | Product sheet | Graphite | Type | Density* (/mm$^2$) |
| INVENTION | 1b | 910 | | 0.2 | No | Hot rolled sheet | No | Mg—O—S | 180 |
| | 2b | 950 | | 20 | Yes | Cold rolled strip | No | Ca—O—S | 60 |
| | 3b | 1000 | 730 | 8 | Yes | Cold rolled strip | No | REM-O—S | 150 |
| | 4b | 920 | | 1 | No | Hot rolled sheet | No | Mg—O—S | 1000 |
| | 5b | 1100 | | 8 | No | Hot rolled sheet | No | Mg—O—S<br>Ca—O—S | 250 |
| | 6b | 950 | | 0.1 | Yes | Cold rolled strip | No | Mg—O—S<br>REM-O—S | 500 |

TABLE 3-continued

| | | | | | | | | |
|---|---|---|---|---|---|---|---|---|
| 7b | 1010 | | 5 | Yes | Cold rolled strip | No | REM-O—S | 150 |
| 8b | 1100 | | 2 | No | Hot rolled sheet | No | Ca—O—S | 60 |
| 9b | 910 | 650 | 15 | No | Hot rolled sheet | No | Mg—O—S<br>Ca—O—S | 220 |
| 10b | 1120 | | 3 | Yes | Cold rolled strip | No | Mg—O—S | 180 |
| 11b | 950 | | 0.5 | No | Hot rolled sheet | No | Mg—O—S<br>REM-O—S | 300 |
| 12b | 950 | | 1 | Yes | Cold rolled strip | No | Mg—O—S<br>REM-O—S | 150 |
| 13b | 950 | 700 | 1 | No | Hot rolled sheet | No | Mg—O—S<br>Ca—O—S | 250 |
| 14b | 1050 | — | 0.2 | Yes | Cold rolled strip | No | Mg—O—S | 800 |
| 15b | 950 | 700 | 2 | No | Hot rolled sheet | No | REM-O—S | 120 |
| 16b | 1000 | — | 5 | No | Hot rolled sheet | No | Mg—O—S | 300 |
| 17b | 1100 | — | 20 | No | Hot rolled sheet | No | Mg—O—S<br>Ca—O—S | 450 |

| | | Product sheet | | | | | | | | | |
|---|---|---|---|---|---|---|---|---|---|---|---|
| | | Graphite | | | | | Inclusions | | | | |
| | No. | Present | Form | Length (mm) | Width (mm) | Density (/mm$^2$) | Type | Density* (/mm$^2$) | State | Ferrite rate (%) | Workability |
| INVENTION | 1b | Yes | Flattened, dispersed | 45 | 0.1 | 120 | Mg—O—S | 180 | In graphite | 99 | 1 |
| | 2b | Yes | Flattened, dispersed | 30 | 0.2 | 50 | Ca—O—S | 60 | In graphite | 5 | 3 |
| | 3b | Yes | Flattened, dispersed | 20 | 0.2 | 120 | REM-O—S | 150 | In graphite | 75 | 2 |
| | 4b | Yes | Flattened, dispersed | 50 | 0.4 | 900 | Mg—O—S | 1000 | In graphite | 80 | 1 |
| | 5b | Yes | Flattened, dispersed | 15 | 0.1 | 240 | Mg—O—S<br>Ca—O—S | 250 | In graphite | 50 | 3 |
| | 6b | Yes | Flattened, dispersed | 10 | 0.08 | 400 | Mg—O—S<br>REM-O—S | 500 | In graphite | 100 | 1 |
| | 7b | Yes | Flattened, dispersed | 5 | 0.05 | 110 | REM-O—S | 150 | In graphite | 60 | 2 |
| | 8b | Yes | Flattened, dispersed | 25 | 0.1 | 50 | Ca—O—S | 60 | In graphite | 80 | 1 |
| | 9b | Yes | Flattened, dispersed | 48 | 0.35 | 200 | Mg—O—S<br>Ca—O—S | 220 | In graphite | 70 | 2 |
| | 10b | Yes | Flattened, dispersed | 40 | 0.25 | 150 | Mg—O—S | 180 | In graphite | 75 | 2 |
| | 11b | Yes | Flattened, dispersed | 20 | 0.2 | 250 | Mg—O—S<br>REM-O—S | 300 | In graphite | 95 | 1 |
| | 12b | Yes | Flattened, dispersed | 55 | 0.5 | 100 | Mg—O—S<br>REM-O—S | 150 | In graphite | 100 | 1 |
| | 13b | Yes | Flattened, dispersed | 20 | 0.2 | 220 | Mg—O—S<br>Ca—O—S | 250 | In graphite | 95 | 1 |
| | 14b | Yes | Flattened, dispersed | 50 | 0.2 | 100 | Mg—O—S | 800 | In graphite | 100 | 1 |
| | 15b | Yes | Flattened, dispersed | 20 | 0.4 | 110 | REM-O—S | 120 | In graphite | 95 | 1 |
| | 16b | Yes | Flattened, dispersed | 5 | 0.1 | 200 | Mg—O—S | 300 | In graphite | 90 | 1 |
| | 17b | Yes | Flattened, dispersed | 40 | 0.5 | 300 | Mg—O—S<br>Ca—O—S | 450 | In graphite | 10 | 3 |

*"No. of inclusions" is number of size of 0.05 to 5 μm,

** "Workability" is evaluated by bending test scored as 1: excellent, 2: good, 3: fair, 4: poor.

What is claimed:

1. A method of production of a rolled cast iron, wherein spheroidal particles of graphite are dispersed within the rolled cast iron, the method comprising:

casting a melting white cast iron comprising, by wt %, C and Si in amounts satisfying (% C)≦4.3−(% Si)/3 and C no less than 1.7%, to which a spheroidalization agent has been added, using a continuous casting machine using a water-cooled copper mold or a thin slab continuous casting machine to obtain a cast iron, heating the cast iron to no more than 850° C., then rolling the cast iron to obtain a rolled cast iron, and heating the rolled cast iron to a temperature of no more than 1150° C. for 60 minutes or less.

2. The method of production of a rolled cast iron, as set forth in claim 1, further comprising: after heating the rolled cast iron to 1150° C. or less, holding the rolled cast iron at the temperature between 600° to 730° C. for 30 to 60 minutes.

3. The method of production of a rolled cast iron, as set forth in claim 1, further comprising, after heating the rolled cast iron to no more than 1150° C., cooling the rolled cast iron in a temperature region of between 730° and 300° C. at a cooling rate of no more than 10° C./minute.

* * * * *

UNITED STATES PATENT AND TRADEMARK OFFICE

CERTIFICATE OF CORRECTION

PATENT NO. : 8,302,667 B2
APPLICATION NO. : 13/173154
DATED : November 6, 2012
INVENTOR(S) : Hideaki Yamamura et al.

It is certified that error appears in the above-identified patent and that said Letters Patent is hereby corrected as shown below:

In the Specifications

Column 1, line 26, change "as "C/V cast iron"." to -- as "C/V cast iron"). --;

Column 13, lines 17-32, delete paragraph;

Column 13, line 33, add new paragraph: "From the results of the above examples, it was learned that in the invention examples, cast iron sheets in which particles of fine spheroidal graphite or flattened graphite particles are dispersed can be produced. These cast iron sheets could be worked by bending without cracking. In particular, sheets with ferrite rates of 60% or more secured bending workability, while sheets with ferrite rates of 70% or more were excellent in workability.".

Signed and Sealed this
Seventeenth Day of December, 2013

Margaret A. Focarino

Margaret A. Focarino
*Commissioner for Patents of the United States Patent and Trademark Office*